US006258317B1

(12) United States Patent
Smith et al.

(10) Patent No.: US 6,258,317 B1
(45) Date of Patent: Jul. 10, 2001

(54) ADVANCED ULTRA-SUPERCRITICAL BOILER TUBING ALLOY

(75) Inventors: Gaylord Darrell Smith; Shailesh Jayantilal Patel, both of Huntington, WV (US); Norman Charles Farr, Hereford (GB)

(73) Assignee: Inco Alloys International, Inc., Huntington, WV (US)

( * ) Notice: Subject to any disclaimer, the term of this patent is extended or adjusted under 35 U.S.C. 154(b) by 0 days.

(21) Appl. No.: 09/100,605

(22) Filed: Jun. 19, 1998

(51) Int. Cl.[7] ..... C22C 19/05

(52) U.S. Cl. ..... 420/448; 420/588; 148/410; 148/442

(58) Field of Search ..... 420/448, 588; 148/410, 428, 442

(56) References Cited

U.S. PATENT DOCUMENTS

| | | | |
|---|---|---|---|
| 3,151,981 | 10/1964 | Smith et al. | 75/171 |
| 3,479,157 | 11/1969 | Richards et al. | 29/194 |
| 3,681,059 | 8/1972 | Shaw et al. | 75/134 |
| 3,723,107 | 3/1973 | Richards et al. | 75/171 |
| 3,723,108 | 3/1973 | Twigg et al. | 75/171 |
| 3,859,060 | 1/1975 | Eiselstein et al. | 29/193 |
| 4,039,330 | 8/1977 | Shaw | 75/171 |
| 4,474,733 | 10/1984 | Susukida et al. | 420/443 |
| 4,727,740 | 3/1988 | Yabuki et al. | 72/209 |
| 4,810,467 | 3/1989 | Wood et al. | 420/448 |
| 4,981,644 | 1/1991 | Chang | 420/442 |
| 5,370,497 | 12/1994 | Doi et al. | 415/199.5 |
| 5,372,662 | 12/1994 | Ganesan et al. | 148/428 |
| 5,556,594 | 9/1996 | Frank et al. | 420/448 |

FOREIGN PATENT DOCUMENTS

| | | |
|---|---|---|
| 880805 | 10/1961 | (GB) . |
| 61-147838 | 7/1986 | (JP) . |

OTHER PUBLICATIONS

Nimonic® alloy 263, Product Specification, Inco Alloys International, Inc. (1996).

*Primary Examiner*—John Sheehan
*Assistant Examiner*—Andrew L. Oltmans
(74) *Attorney, Agent, or Firm*—Robert F. Dropkin, Esq.; Webb Ziesenheim Logsdon Orkin & Hanson, P.C.

(57) ABSTRACT

An ultra supercritical boiler tubing alloy characterized by a microstructure stabilized and strengthened for 375 bar/700° C. steam, in weight percent, service and alloyed to resist coal ash/flue gas corrosion for 200,000 hours consisting of 10 to 24 cobalt, 22.6 to 30 chromium, 2.4 to 6 molybdenum, 0 to 9 iron, 0.2 to 3.2 aluminum, 0.2 to 2.8 titanium, 0.1 to 2.5 niobium, 0 to 2 manganese, 0 to 1 silicon, 0.01 to 0.3 zirconium, 0.001 to 0.01 boron, 0.005 to 0.3 carbon, 0 to 4 tungsten, 0 to 1 tantalum and balance nickel and incidental impurities.

16 Claims, 3 Drawing Sheets

ADVANCED ULTRA-SUPERCRITICAL BOILER TUBING ALLOY

FIELD OF THE INVENTION

This invention relates to high strength alloys that possess corrosion resistance at high temperatures. In particular, it's related to alloys having sufficient strength, corrosion resistance, thermal stability and fabricability for service as ultra supercritical boiler tubing.

BACKGROUND OF THE INVENTION

To meet the ever-increasing demand for electric power at lower consumer cost, utility plant designers are planning new facilities that will operate at steam pressures and temperatures well beyond those currently employed. To meet their target efficiencies of greater than 60% versus today's design efficiencies of around 47%, steam parameters must be raised to 375 bar/700° C. from today's typical 290 bar/580° C. conditions. Unfortunately, an economical superheater tubing alloy capable of meeting the advanced steam parameters does not currently exist. Examination of currently available boiler tube alloys reveals the difficulty in achieving the required combination of strength, corrosion resistance, thermal stability and manufacturability.

To meet the 38 MPa (developed by the 375 bar steam pressure) hoop stress requirement of the steam tubing, the 100,000 hour stress rupture life must exceed 100 MPa at 750° C. (midradius tube wall temperature needed to maintain a 700° C. steam temperature at the inner wall surface). Because coal ash corrosion is capable of degrading most superheater tubing alloys, utility plant designers have placed stringent corrosion allowances on candidate alloys. The total metal loss due to inner wall steam erosion and outer wall coal ash/flue gas corrosion must not exceed 2 mm in 200,000 hours (target life for the superheater section of the steam boiler operating between 700° C. and 800° C.). In addition, the tube size, primarily for purposes of economy, must not exceed 50 mm outer diameter (O.D.) and 8 mm wall thickness and optimally be less than 40 mm O.D. with a maximum wall thickness of 6 mm. Further, the alloy must be fabricable in high yield using conventional tube-making practices and equipment. This places a maximum constraint on work-hardening rate and yield strength of the candidate alloy range, which runs counter to the need for superior strength and stress rupture life at service temperatures.

To achieve the boiler tube strength requirement, ferritic and austenitic steels must be excluded and even nickel-base solid solution alloys lack adequate strength. One is required to consider gamma prime containing alloys even though virtually all gamma prime containing alloys lack adequate chromium to ensure satisfactory coal ash/flue gas corrosion resistance and few of these high strength alloys possess adequate formability to be made into tubing. Adding chromium can degrade the strengthening mechanism and if added in excess, depending on composition, can result in embrittling sigma, mu or alpha-chromium precipitation. To ensure acceptable resistance on the steam side to "downtime" stress corrosion cracking (SCC) and pitting beneath the scale during operation, a minimum nickel and, advantageously a minimum molybdenum content must be present in the alloy. Since 700° C. to 800° C. is a very active range for carbide formation and embrittling phase precipitation, alloying content in the nickel plus cobalt matrix must be precisely limited.

Field fabrication places further restraint on composition. Tubing must be amenable to bending and welding during superheater boiler construction, necessitating that the alloy be supplied in the annealed condition (lowest possible practical yield strength). Whereas the strength requirement during operation demands the highest possible strength at operating temperature, requiring that the alloy be given an aging heat treatment to achieve peak strength values. Dealing with these seemingly incongruous constraints and ultimately resolving this material challenge with a cost effective alloy is the object of this invention.

SUMMARY OF THE INVENTION

An ultra supercritical boiler tubing alloy characterized by a microstructure stabilized and strengthened for 375 bar/700° C. steam, service and alloyed to resist coal ash/flue gas corrosion for 200,000 hours consisting of, in weight percent, 10 to 24 cobalt, 22.6 to 30 chromium, 2.4 to 6 molybdenum, 0 to 9 iron, 0.2 to 3.2 aluminum, 0.2 to 2.8 titanium, 0.1 to 2.5 niobium, 0 to 2 manganese, 0 to 1 silicon, 0.01 to 0.3 zirconium, 0.001 to 0.01 boron, 0.005 to 0.3 carbon, 0 to 4 tungsten, 0 to 1 tantalum and balance nickel and incidental impurities.

DESCRIPTION OF PREFERRED EMBODIMENT

Figure 1:
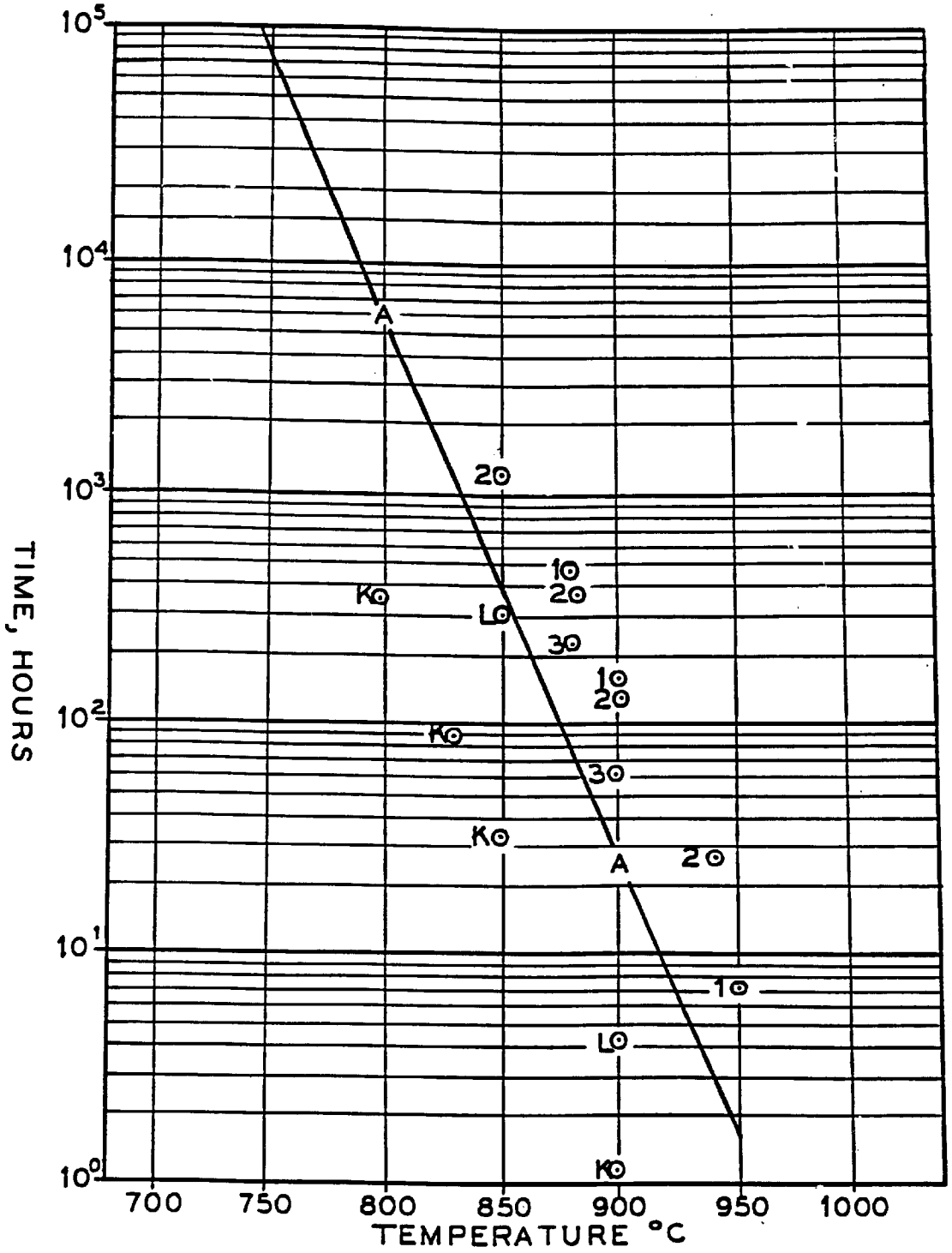
FIG. 1 plots time to failure (logarithmic) versus temperature at an isostress of 100 MPa.

This Ni—Cr—Co alloy has sufficient strength, corrosion resistance, thermal stability and fabricability to serve several demanding high temperature applications. Its high chromium in combination with a relatively small amount of molybdenum and gamma prime strengtheners increase corrosion resistance and strength of the alloy without compromising the thermal stability and fabricability of the alloy.

Functions of several critical elements determine the alloys' properties or characteristics. For example, the combined elements aluminum, niobium and titanium define the minimum strength and limit the fabricability of the alloy. In addition, the total proportion of chromium, aluminum, titanium and niobium, as given in Equation (1), defines the minimum compositional limits for acceptable resistance to coal ash/flue gas corrosion. Carbide and embrittling phase formation chiefly limit the maximum content of the weight percent of chromium, molybdenum, titanium, niobium and carbon. See Equation (2). A minimum of 45 weight percent nickel and 2.4 weight percent molybdenum provide resistance to steam side stress corrosion cracking (SCC) and pitting attack—this specification refers to all elements in weight percent, unless expressly stated otherwise. A narrow range of weight percent aluminum, titanium and niobium facilitate field fabricability and aging heat treatments such that the alloy will age to peak strength in the first few hours of operation, yet possess adequate field fabricability. The minimum alloying content for acceptable stress rupture strength is given by Equation (3) and the maximum alloying content for acceptable field fabricability by Equation (4).

The maximum metal loss by corrosion of 2 mm in 200,000 hours at 700° C. to 800° C. is achieved when the compositional limit is:

$$\%Cr+0.6\times\%Ti+0.5\times\%Al+0.3\times\%Nb \geqq 24\%, \text{ preferably} \geqq 25\% \quad (1)$$

Note: Equation 1 requires a minimum weight percent chromium equal to at least 22.6% for adequate corrosion resistance.

While the maximum compositional limit below which embrittling phase precipitation tends to be absent is:

$$\%(Cr+0.8\%\times Mo)+0.6\times\%Ti+0.5\times\%Al+0.3\times\%Nb \leqq 37.5\%, \text{ preferably} \leqq 35.0\% \quad (2)$$

Note: Equation 2 defines a maximum weight percent chromium of less than or equal to 30, preferably 28.5 to limit detrimental embrittling phases such as sigma. To minimize carbide precipitation, the maximum weight percent carbon must be less than or equal to 0.30, and preferably less than 0.15.

The formula for minimum aged stress rupture strength of 100,000 hours at 750° C. and 100 MPa is:

$$\%Al+0.56\times\%Ti+0.29\times\%Nb \geqq 1.7\%, \text{ preferably} \geqq 2.0\%. \quad (3)$$

While the maximum compositional limit to ensure fabricability is:

$$\%Al+0.56\times\%Ti+0.29\times\%Nb \leqq 3.4\%, \text{ preferably} \leqq 3.0\%. \quad (4)$$

A minimum of at least 10 weight percent cobalt strengthens the matrix and increases stress rupture strength. Further increases in cobalt facilitate achieving the requisite strength. Cobalt levels above 24 weight percent however, tend to diminish the thermal stability of the alloy. The alloy accepts iron as an impurity. Generally, decreasing iron content, improves corrosion resistance properties. But for commercial recycling concerns, allowing small amounts of iron into the alloy facilitates lowering the cost of this alloy.

The alloy tolerates up to 2 weight percent manganese without an excess loss in corrosion properties. Although not critical for the alloy, this element contributes to fabricability and strength by tying up sulfur. In addition, this alloy system accepts silicon as an impurity. For commercial cost considerations however, the alloy may contain up to one weight percent silicon.

As little as 0.01 weight percent zirconium improves the oxidation resistance of the alloy. Zirconium in excess of 0.3 weight percent however decreases the fabricability of the alloy. Unlike zirconium, 0.001 to 0.01 weight percent boron enhances the hot workability of the alloy. Carbon in amounts of 0,005 to 0.3 weight percent provides further strength to the matrix.

Tantalum and tungsten represent important impurities that detract from the overall properties of the alloy. To maintain corrosion resistance and thermal stability, total molybdenum plus tantalum plus tungsten should remain below 6 weight percent. For optimum results, this total remains below 3.5 weight percent.

Equations 1 to 4, in conjunction with Table 1 below, define "about" the ranges for achieving the best combination of properties.

TABLE 1

| ELEMENT | BROAD RANGE (wt %) | INTERMEDIATE RANGE (wt %) | NARROW RANGE (wt %) | NOMINAL RANGE (wt %) |
|---|---|---|---|---|
| Ni | Bal.(1) | Bal.(1) | Bal.(1) | Bal.(1) |
| Co | 10–24 | 12–23 | 15–22 | 18–21 |
| Cr | 22.6–30 | 22.8–29 | 23–28 | 23.5–25 |
| Mo | 2.4–6 | 2.4–5 | 2.5–3.5 | 2.8–3.2 |
| Fe | 0–9 | 0.1–4 | 0.3–2 | 0.5–1 |
| Al | 0.2–3.2 | 0.3–2.5 | 0.5–2 | 0.8–1.8 |
| Ti | 0.2–2.8 | 0.3–2.7 | 0.4–2.6 | 0.5–2.5 |
| Nb | 0.1–2.5 | 0.2–2.2 | 0.8–2.1 | 1.2–2 |
| Mn | 0–2 | 0.1–1 | 0.1–0.5 | 0.2–0.4 |
| Si | 0–1 | 0.1–0.8 | 0.2–0.7 | 0.3–0.6 |
| Zr | 0.01–0.3 | 0.01–0.2 | 0.03–0.15 | 0.05–0.1 |
| B | 0.001–0.01 | 0.002–0.009 | 0.003–0.008 | 0.004–0.007 |
| C | 0.005–0.3 | 0.01–0.2 | 0.02–0.15 | 0.03–0.12 |
| W | 0–4 | 0–2 | 0–1 | 0–0.8 |
| Ta | 0–1 | 0–0.8 | 0–0.7 | 0–0.5 |

(1)Plus incidental impurities

Table 2A provides specific examples of alloys within the scope of the invention.

TABLE 2A

| ALLOY | C | Si | Mn | Fe | Ni | Cr | Ti | Al | Co | Mo | Nb |
|---|---|---|---|---|---|---|---|---|---|---|---|
| 1 | 0.07 | 0.33 | 0.26 | 0.62 | 45.15 | 23.04 | 2.03 | 0.59 | 19.79 | 5.89 | 2.05 |
| 2 | 0.08 | 0.34 | 0.35 | 0.61 | 44.77 | 22.93 | 2.16 | 0.80 | 19.34 | 5.88 | 2.06 |
| 3 | 0.04 | 0.31 | 0.31 | 0.65 | 49.28 | 22.93 | 1.82 | 0.87 | 19.89 | 3.09 | 0.70 |
| 4 | 0.03 | 0.30 | 0.31 | 0.68 | 48.77 | 22.95 | 0.85 | 1.10 | 19.86 | 3.09 | 1.94 |
| 5 | 0.03 | 0.33 | 0.31 | 0.63 | 48.07 | 24.07 | 0.53 | 1.59 | 19.89 | 3.10 | 1.32 |
| 6 | 0.03 | 0.34 | 0.31 | 0.61 | 47.72 | 24.01 | 0.57 | 1.79 | 19.92 | 3.08 | 1.42 |
| 7 | 0.03 | 0.33 | 0.31 | 0.61 | 47.76 | 24.01 | 0.71 | 1.41 | 19.91 | 3.08 | 1.71 |

All of the compositions contained in Table 2A nominally contained 0.005 weight percent boron, 0.06 to 0.15 weight percent zirconium, less than 0.05 weight percent tantalum and less than 0.2 weight percent tungsten.

Table 2B provides specific examples of alloys outside of the scope of this invention.

TABLE 2B

| ALLOY | C | Si | Mn | Fe | Ni | Cr | Ti | Al | Co | Mo | Nb | OTHER |
|---|---|---|---|---|---|---|---|---|---|---|---|---|
| A | 0.06 | 0.50 | 0.30 | 0.70 | 74.24 | 20.00 | 2.30 | 1.20 | — | — | 0.70 | — |
| B | 0.13 | 1.00 | 1.00 | 1.50 | 54.37 | 20.00 | 2.50 | 1.50 | 18.00 | — | — | — |
| C | 0.12 | 1.00 | 1.00 | 1.00 | 81.10 | 15.00 | 1.20 | 4.70 | — | 5.00 | — | |
| D | 0.07 | 0.50 | 0.06 | — | 46.23 | 28.50 | 2.35 | 1.35 | 20.3 | — | 0.64 | — |
| E | 0.08 | 0.50 | 1.00 | 7.00 | 72.32 | 15.00 | 2.50 | 0.70 | — | — | 0.90 | — |
| F | 0.03 | 0.35 | 0.35 | 18.20 | 52.67 | 19.00 | 0.90 | 0.50 | — | 3.00 | 5.00 | — |
| G | 0.03 | 0.50 | 0.50 | 9.50 | 59.47 | 30.00 | — | — | — | — | — | — |
| H | 0.08 | 0.50 | 0.50 | 1.50 | 52.92 | 22.00 | 0.30 | 1.20 | 12.50 | 9.00 | — | — |
| I | 0.05 | — | — | 0.50 | 51.10 | 48.00 | 0.35 | — | — | — | — | — |
| J | 0.55 | 0.40 | 1.00 | 31.75 | 20.00 | 22.00 | — | 0.20 | 18.00 | 3.00 | — | W 2.50 Ta 0.60 |
| K | 0.05 | 0.56 | 0.22 | 8.76 | 34.82 | 29.99 | 0.25 | 3.06 | 19.97 | 0.29 | 1.89 | — |
| L | 0.03 | 0.31 | 0.42 | 1.93 | 48.99 | 22.77 | 1.18 | 0.62 | 19.40 | 3.02 | 1.19 | — |
| M | 0.09 | 0.83 | 0.21 | 1.55 | 47.41 | 27.99 | 1.53 | 0.21 | 19.97 | 0.12 | 0.01 | — |

SCREENING FOR COAL ASH/FLUE GAS CORROSION RESISTANCE

It is imperative that a candidate superheater boiler tubing alloy exhibit superior coal ash/flue gas corrosion resistance, if it is to meet utility boiler designers'requirements for 200,000 hours life at 700° C. to 800° C. High temperature fireside corrosion in conventional boilers is caused by flue gas oxidation and liquid-phase coal ash corrosion. Coal ash corrosion is generally accepted as due to the presence of liquid sulfates on the surface of the tubing beneath an overlying ash deposit. The rate of this corrosion is alloy dependent and is also a function of the amount of sodium and potassium sulfate present in the coal ash and the level of $SO_2$ present in the flue gas. It is generally accepted that the severity of corrosion is at a maximum at approximately 700° C. Volatilization of the liquid sulfates above 700° C. is responsible for reduction of the rate of corrosion at somewhat higher temperatures. To qualify the alloys for this service, screening tests were conducted at 700° C. in a flue atmosphere of 15% $CO_2$-4%$O_2$-1.0%$SO_2$-Bal.$N_2$ flowing at the rate of 250 cubic centimeters per minute. The specimens were coated with a synthetic coal ash comprising 2.5% $Na_2SO_4$-2.5% $K_2SO_4$-31.67%$Fe_2O_3$-31.67%$SiO_2$-31.67%$Al_2O_3$. Pins were machined from vacuum melted, hot worked and annealed rod to approximately 9.5 mm diameter by 19.1 mm length. Each pin was given a 120 grit finish and subsequently coated using a water slurry of the coal ash. The weight of the coal ash coating was approximately 15 mg/cm$^2$. The screening was conducted for 1,000 hours after which the specimens were metallographically sectioned and the rate of metal loss and depth of attack by sulfidation determined. Specimens that exhibited a rate of metal loss or depth of sulfidation of less than 0.01 mm in 1,000 hours would have a corrosion loss of less than 2 mm in 200,000 hours. Table 3 presents these results for the compositions of Tables 2A and B.

TABLE 3

| ALLOY | EQUATION 1 | CORROSION RATE (mm) |
|---|---|---|
| 1 | 25.2 | 0.0026 |
| 2 | 25.3 | 0.0010 |
| 3 | 24.7 | 0.0100 |
| 4 | 24.5 | 0.0050 |
| 5 | 24.6 | 0.0100 |
| 6 | 25.7 | 0.0076 |
| 7 | 25.7 | 0.0064 |
| A | 21.6 | 0.0150 |
| B | 22.3 | 0.0540 |
| C | 18.1 | 0.0710 |
| D | 30.7 | 0.0010 |
| E | 17.2 | 0.0480 |
| F | 30.0 | 0.0005 |
| H | 22.8 | 0.0160 |
| I | 48.2 | 0.0007 |
| J | 22.1 | 0.0070 |
| K | 32.2 | 0.0010 |
| L | 24.1 | 0.0100 |
| M | 29.0 | 0.0010 |

The alloys of Table 3 must pass the corrosion screen test of 0.01 mm or less corrosion rate after 1,000 hours in coal ash/flue gas at 700° C. for consideration of mechanical properties.

SCREENING FOR 100,000 HOURS/750° C./100 MPa STRESS RUPTURE LIFE

The utility boiler designers have determined that an alloy tubing capable of achieving 100,000 hours at 750° C. and 100 MPa would meet their design criteria. This strength level exceeds that of convention boiler tube alloys and virtually all iron-and nickel-base solid solution alloys. The gamma prime strengthened alloys have the potential to achieve these strength levels. However, these alloys typically possess low chromium levels which limit their corrosion resistance and, for the most part, are too hard and low in ductility even in the annealed condition to be fabricable into tubing. Alloy A in Table II is a gamma prime strengthened alloy that is capable of both being fabricated into tubing and achieving the strength target. Referring to FIG. 1, alloys with data points plotted to the right of alloy A would also meet the strength requirements, while those to the left of alloy A would fail prematurely at a temperature of 750° C. with a stress of 100 MPa for 100,000 hours. Table 4A contains the compositional limit value and the pass/fail analysis of the alloys within the patent application and Table 4B presents the results for the alloys of Table 2B . Note that alloys D, G, I, K, L and M which passed the corrosion screen fail to meet the strength target; alloys A, B and C failed the corrosion screen but passed the strength screen; while alloys E, F, H and J failed both screening tests.

TABLE 4A

| ALLOY | EQUATION 3 | STATUS |
|---|---|---|
| 1 | 2.32 | PASS |
| 2 | 2.61 | PASS |
| 3 | 2.09 | PASS |
| 4 | 2.14 | PASS |
| 5 | 2.27 | PASS |
| 6 | 2.50 | PASS |
| 7 | 2.31 | PASS |

TABLE 4B

| ALLOY | EQUATION 3 | STATUS |
|---|---|---|
| A | 2.69 | PASS |
| B | 2.90 | PASS |
| C | 5.37 | PASS |
| D | 2.85 | FAIL |
| E | 2.36 | FAIL |
| F | 2.45 | FAIL |
| G | 0.00 | FAIL |
| H | 1.38 | FAIL |
| I | 0.09 | FAIL |
| J | 0.20 | FAIL |
| K | 3.75 | FAIL |
| L | 1.63 | FAIL |
| M | 1.07 | FAIL |

Figure 2:
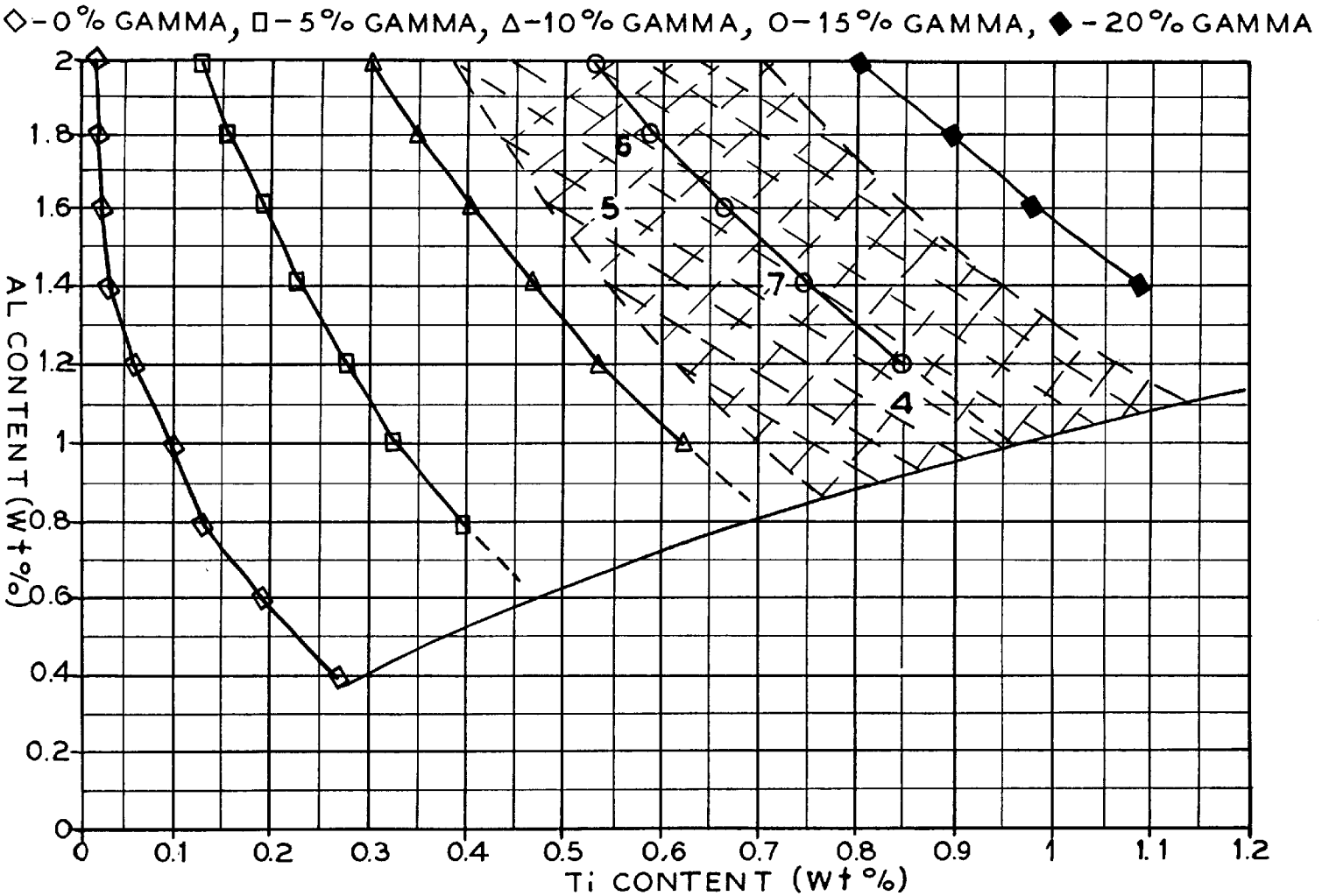
FIG. 2 depicts volume gamma prime from 0 to 20 volume percent for nickel-20 cobalt-23 chromium-3 molybdenum as a function of the aluminum, titanium and niobium contents at a titanium to niobium ratio of 1.5 to 0.7.

Analysis of the microstructural phases using ThermoCalc (an analytical program that predicts phase stability based on thermodynamic data) lead to the conclusion that a minimum volume percent of 12% gamma prime was required to achieve the target stress rupture life of 750° C./100 MPa/100,000 hours and that the alloys containing approximately 18 to 20% gamma prime were too hard or too low in ductility to fabricate into tubing. Referring to FIG. 2, the preferred compositional range when the titanium to niobium ratio is 1.5 to 0.7 is shown as a cross-hatched area. Four heats from Table 2 that are defined by this ratio are plotted by heat number.

SCREENING FOR MECHANICAL PROPERTY STABILITY

Mechanical property stability over the desired service life of 200,000 hours at the projected operating temperatures necessitates phase stability of the tubing alloy in order to withstand the stresses of periodic shutdowns, temperature fluctuations and hot spot variations over short lengths. High temperature alloys are especially susceptible to precipitation of carbide and embrittling phases in the temperature range of 700° C. to 800° C. Limiting carbon to 0.3% and preferably less than 0.15% essential if $Cr_{23}C_6$and $(Cr,Mo)_6C$ type carbides are to be held to acceptable levels. This is especially true because of the 22.6-30% chromium content required for corrosion resistance. Limiting the maximum content of chromium, molybdenum, aluminum, titanium and niobium elemental levels is required if embrittling phases such as sigma, mu and alpha-chromium are to be avoided. Table 5A presents the compositional limits as defined by Equation (2) for the upper limits desired for maximum embrittling phase content for the alloys of this invention and Table 5B for the alloys outside the limits of this patent application for general information.

TABLE 5A

| ALLOY | EQUATION 2 |
|---|---|
| 1 | 29.9 |
| 2 | 30.0 |
| 3 | 27.2 |
| 4 | 27.0 |
| 5 | 27.1 |
| 6 | 28.2 |
| 7 | 28.2 |

TABLE 5B

| ALLOY | EQUATION 2 |
|---|---|
| A | 26.2 |
| B | 22.3 |
| C | 22.1 |
| D | 30.7 |
| E | 17.2 |
| F | 23.7 |
| G | 30.0 |
| H | 30.0 |
| I | 48.2 |
| J | 24.5 |
| K | 32.4 |
| L | 26.5 |
| M | 32.3 |

Figure 3:
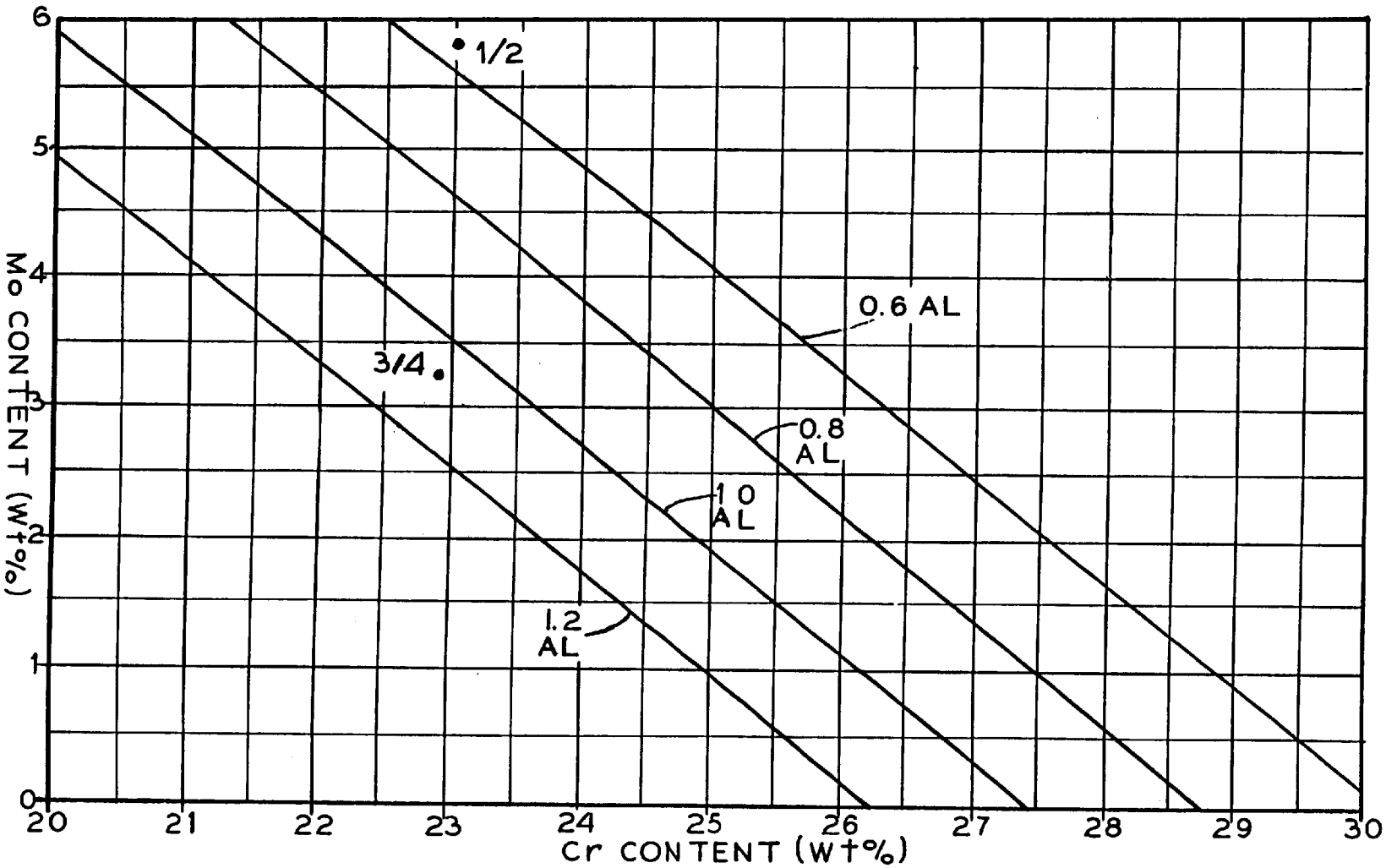
FIG. 3 depicts the compositional phase boundaries at 750° C. for the formation of sigma phase for the aluminum range 0.6 to 1.2 weight percent in a nickel-20 cobalt-23 chromium-6 molybdenum matrix.

Of paramount importance is that the alloys be as free of sigma, mu and alpha-chromium as possible. That the alloys of this patent application were developed with this limitation in mind as shown in FIG. 3. That the aluminum content is important is made clear by the role that aluminum plays in forming gamma prime ($Ni_3Al$), which diminishes the contribution that nickel exhibits in stabilizing the matrix against chromium-based phases. Selected alloys of Table 2A are shown by their number designation as a function of their chromium and molybdenum contents. Surprisingly, this boundary is important with respect to molybdenum content in that alloys with excessive molybdenum (beyond its solubility limit) exhibited markedly decreased resistance to coal ash/flue gas corrosion. FIG. 3 predicts alloys 3 and 4 would be completely free of sigma phase while small amounts of sigma phase would potentially form in the remainder of the alloys of Table 2A. Table 6 contrasts the corrosion rate of the qualifying alloys, as a function of the molybdenum content, at a near constant chromium level of 23 weight percent.

TABLE 6

| ALLOY | MOLYBDENUM CONTENT (%) | CHROMIUM CONTENT (%) | CORROSION RATE PER 1,000 (MM) |
|---|---|---|---|
| 3 | 3.09 | 22.93 | 0.0050 |
| 2 | 5.89 | 23.09 | 0.0026 |
| H | 9.00 | 22.00 | 0.0160 |

This nickel-base alloy range is useful for multiple-high-temperature-high-stress applications, such as, gas turbine engines and high-temperature boilers. The fabricability allows manufactures to form this alloy range into plate, sheet, strip or tubing with conventional fabricating equipment. The alloy range possesses the strength, corrosion resistance, thermal stability and manufacturability for advanced ultra-supercritical boiler tubing. Tubing of this alloy range having greater than 4 mm wall thickness with a 36 mm O.D. has the unique ability to exceed a stress rupture life of 100,000 hours at 100 MPa at 750° C. and coal ash/flue gas corrosion of less than 2 mm for 200,000 hours at 700° C.

In accordance with the provisions of the statute, this specification illustrates and describes specific embodiments of the invention. Those skilled in the art will understand that the claims cover changes in the form of the invention and that certain features of the invention may operate advantageously without a corresponding use of the other features.

We claim:

1. A nickel-base alloy, suitable for use as boiler superheater tubing, consisting essentially of, by weight percent, about 10 to 24 cobalt, about 23.5 to 30 chromium, about 2.4 to 6 molybdenum, about 0 to 9 iron, about 0.2 to 3.2 aluminum, about 0.2 to 2.8 titanium, about 0.1 to 2.5 niobium, about 0 to 2 manganese, about 0 1 to silicon, about 0.01 to 0.3 zirconium, about 0.001 to 0.01 boron, about 0.005 to 0.3 carbon, about 0 to 0.8 tungsten, about 0 to 1 tantalum and balance nickel and incidental impurities, the alloy being further characterized by satisfying:

1) $\%Cr+0.6\times\%Ti+0.5\%\times\%Al+0.3\times\%Nb\geqq 24\%$;

2) $\%(Cr+0.8\%\times Mo)+0.6\times\%Ti+0.5\times\%Al+0.3\times\%Nb\leqq 37.5\%$;

3) $\%Al+0.56\times\%Ti+0.29\times\%Nb\geqq 1.7\%$;

4) $\%Al+0.56\times\%Ti+0.29\times\%Nb\leqq 3.0\%$; and wherein the alloy contains about 12 to 18 volume percent gamma prime phase.

2. The alloy of claim 1 containing about 12 to 23 cobalt, about 23.5 to 29 chromium, about 2.4 to 5 molybdenum, about 0.3 to 2.5 aluminum, about 0.3 to 2.7 titanium and about 0.2 to 2.2 niobium.

3. The alloy of claim 1 containing about 0.1 to 4 iron, about 0.1 to 1 manganese, about 0.1 to 0.8 silicon, about 0.01 to 0.2 zirconium, about 0.002 to 0.009 boron, about 0.01 to 0.2 carbon, and about 0 to 0.8 tantalum.

4. The alloy of claim 1 characterized by a 100,000 hour 100 MPa stress rupture life at a temperature of 750° C.

5. A nickel-base alloy, suitable for use as boiler superheater tubing, consisting essentially of, by weight percent, about 12 to 23 cobalt, about 23.5 to 29 chromium, about 2.4 to 5 molybdenum, about 0.1 to 4 iron, about 0.3 to 2.5 aluminum, about 0.3 to 2.7 titanium, about 0.2 to 2.2 niobium, about 0.1 to 1 manganese, about 0.1 to 0.8 silicon, about 0.01 to 0.2 zirconium, about 0.002 to 0.009 boron, about 0.01 to 0.2 carbon, about 0 to 0.8 tungsten, about 0 to 0.8 tantalum and balance nickel and incidental impurities, the alloy being further characterized by satisfying:

1) $\%Cr+0.6\times\%Ti+0.5\%\times\%Al+0.3\times\%Nb\geqq 24\%$;

2) $\%(Cr+0.8\%\times Mo)+0.6\times\%Ti+0.5\times\%Al+0.3\times\%Nb\leqq 37.5\%$;

3) $\%Al+0.56\times\%Ti+0.29\times\%Nb\geqq 1.7\%$;

4) $\%Al+0.56\times\%Ti+0.29\times\%Nb\leqq 3.0\%$; and wherein the alloy contains about 12 to 18 volume percent gamma prime phase.

6. The alloy of claim 5 containing about 15 to 22 cobalt, about 23.5 to 28 chromium, about 2.5 to 3.5 molybdenum, about 0.5 to 2 aluminum, about 0.4 to 2.6 titanium and about 0.8 to 2.1 niobium.

7. The alloy of claim 5 containing about 0.3 to 2 iron, about 0.1 to 0.5 manganese, about 0.2 to 0.7 silicon, about 0.03 to 0.15 zirconium, about 0.003 to 0.008 boron, about 0.02 to 0.15 carbon, and about 0 to 0.7 tantalum.

8. The alloy of claim 5 characterized by a 100,000 hour 100 MPa stress rupture life at a temperature of 750° C.

9. A nickel-base alloy, suitable for use as boiler superheater tubing, consisting essentially of, by weight percent, about 15 to 22 cobalt, about 23.5 to 28 chromium, about 2.5 to 3.5 molybdenum, about 0.3 to 2 iron, about 0.5 to 2 aluminum, about 0.4 to 2.6 titanium, about 0.8 to 2.1 niobium, about 0.1 to 0.5 manganese, about 0.2 to 0.7 silicon, about 0.03 to 0.15 zirconium, about 0.003 to 0.008 boron, about 0.02 to 0.15 carbon, about 0 to 0.8 tungsten, about 0 to 0.7 tantalum and balance nickel and incidental impurities, the alloy being further characterized by satisfying:

1) $\%Cr+0.6\times\%Ti+0.5\%Al+0.3\times\%Nb\geqq 25\%$;

2) $\%(Cr+0.8\%\times Mo)+0.6\times\%Ti+0.5\times\%Al+0.3\times\%Nb\leqq 35.0\%$;

3) $\%Al+0.56\times\%Ti+0.29\times\%Nb\geqq 2.0\%$;

4) $\%Al+0.56\times\%Ti+0.29\times\%Nb\leqq 3.0\%$; and wherein the alloy contains about 12 to 18 volume percent gamma prime phase.

10. The alloy of claim 9, containing about 18 to 21 cobalt, about 23.5 to 25 chromium, about 2.8 to 3.2 molybdenum, about 0.8 to 1.8 aluminum, about 0.5 to 2.5 titanium and about 1.2 to 2 niobium.

11. The alloy of claim 10 containing about 0.5 to 1 iron, about 0.2 to 0.4 manganese, about 0.3 to 0.6 silicon, about 0.05 to 0.1 zirconium, about 0.004 to 0.007 boron, about 0.03 to 0.12 carbon, and about 0 to 0.5 tantalum.

12. The alloy of claim 9 characterized by a 100,000 hour 100 MPa stress rupture life at a temperature of 750° C.

13. An ultra-supercritical boiler tubing alloy characterized by a microstructure stabilized and strengthened for 375 bar/700° C. steam service and alloyed to resist coal ash/flue gas corrosion for 200,000 hours, consisting essentially of, by weight percent, about 10 to 24 cobalt, about 23.5 to 30 chromium, about 2.4 to 6 molybdenum, about 0 to 9 iron, about 0.2 to 3.2 aluminum, about 0.2 to 2.8 titanium, about 0.1 to 2.5 niobium, about 0 to 2 manganese, about 0 to 1 silicon, about 0.01 to 0.3 zirconium, about 0.001 to 0.01 boron, about 0.005 to 0.15 carbon, about 0 to 0.8 tungsten, about 0 to 1 tantalum and balance nickel and incidental impurities, the alloy being further characterized by satisfying:

1) $\%Cr+0.6\times\%Ti+0.5\%\times\%Al+0.3\times\%Nb\geqq 25\%$;

2) $\%(Cr+0.8\%\times Mo)+0.6\times\%Ti+0.5\times\%Al+0.3\times\%Nb\leqq 35.0\%$;

3) $\%Al+0.56\times\%Ti+0.29\times\%Nb\geqq 1.7\%$;

4) $\%Al+0.56\times\%Ti+0.29\times\%Nb\leqq 3.0\%$; and wherein the alloy contains about 12 to 18 volume percent gamma prime phase.

14. A nickel-base alloy, suitable for use as boiler superheater tubing, consisting essentially of, by weight percent, about 18 to 21 cobalt, about 23.5 to 25 chromium, about 2.8 to 3.2 molybdenum, about 0.5 to 1 iron, about 0.8 to 1.8 aluminum, about 0.5 to 2.5 titanium, about 1.2 to 2.0 niobium, about 0.2 to 0.4 manganese, about 0.3 to 0.6 silicon, about 0.05 to 0.1 zirconium, about 0.004 to 0.007 boron, about 0.03 to 0.12 carbon, about 0 to 0.8 tungsten, about 0 to 0.5 tantalum and balance nickel and incidental impurities, the alloy being further characterized by satisfying:

1) $\%Cr+0.6\times\%Ti+0.5\%\times\%Al+0.3\times\%Nb\geqq 25\%$;

2) $\%(Cr+0.8\%\times Mo)+0.6\times\%Ti+0.5\times\%Al+0.3\times\%Nb\leqq 35\%$;

3) $\%Al+0.56\times\%Ti+0.29\times\%Nb\geqq 2.0\%$; and

4) $\%Al+0.56\times\%Ti+0.29\times\%Nb\leqq 3.0\%$.

15. The alloy of claim 14 containing about 12 to 18 volume percent gamma prime phase.

16. The alloy of claim 14 characterized by a 100,000 hour 100 MPa stress rupture life at a temperature of 750° C.

* * * * *

UNITED STATES PATENT AND TRADEMARK OFFICE

CERTIFICATE OF CORRECTION

PATENT NO. : 6,258,317 B1
DATED : July 10, 2001
INVENTOR(S) : Gaylord D. Smith et al.

It is certified that error appears in the above-identified patent and that said Letters Patent is hereby corrected as shown below:

Column 9, claim 1,
Line 17, "about 0 1 to silicon" should read -- about 0 to 1 silicon --.

Signed and Sealed this

Twenty-ninth Day of January, 2002

*Attest:*

*Attesting Officer*

JAMES E. ROGAN
*Director of the United States Patent and Trademark Office*